US006179757B1

(12) United States Patent
Koenig

(10) Patent No.: US 6,179,757 B1
(45) Date of Patent: Jan. 30, 2001

(54) EXERCISE MACHINE FOR UPPER EXTREMITIES

(75) Inventor: Larry Koenig, Williamsburg, IA (US)

(73) Assignee: Jam'n Fitness Corp., Williamsburg, IA (US)

( * ) Notice: Under 35 U.S.C. 154(b), the term of this patent shall be extended for 0 days.

(21) Appl. No.: 09/208,186

(22) Filed: Dec. 9, 1998

(51) Int. Cl.[7] ..... A63B 21/08; A63B 23/02

(52) U.S. Cl. ..... 482/97; 482/100; 482/136; 482/145

(58) Field of Search ..... 482/93, 94, 97, 482/98, 100, 104, 135–137, 139, 133, 140

(56) References Cited

U.S. PATENT DOCUMENTS

| | | | | |
|---|---|---|---|---|
| 4,621,810 | * | 11/1986 | Cummins | 482/97 |
| 4,949,951 | * | 8/1990 | Deola | 482/100 |
| 4,974,835 | * | 12/1990 | Klink | 482/97 |
| 5,184,991 | * | 2/1993 | Brangi | 482/97 |
| 5,290,214 | * | 3/1994 | Chen | 482/137 |
| 5,304,108 | * | 4/1994 | Denega et al. | 482/97 |
| 5,462,510 | * | 10/1995 | Ish, III | 482/142 |
| 5,810,701 | * | 9/1998 | Ellis et al. | 482/136 |
| 5,813,951 | * | 9/1998 | Einsig | 482/97 |
| 6,004,247 | * | 12/1999 | Webber | 482/100 |
| 6,015,370 | * | 1/2000 | Pandozy | 482/97 |

FOREIGN PATENT DOCUMENTS

87/06147 * 10/1987 (WO) .

OTHER PUBLICATIONS

Hammer Strength Rowing/Seated Shrug, Hammer: First in Strength, Hammer Strength brochure, p. 11, received in the PTO Nov. 1994.*

The Pro's Choice for Strength and Fitness! brochure. Pro Industries, 1015 N. Hurricane Road, Franklin, IN 46131.

Hammer Strength Product Information Guide.—P.O. Box 19040, Cincinnati, OH 45219, Feb. 1997.

"Experience the Difference" brochure, Badger Magnum Strength Systems– 1010 David Avenue, South Milwaukee, WI 53172.

Pro Power Weight Training Equipment brochure—Pro Industries, Inc., 1023 N. Hurrincae Rd, Franklin, IN 46131.

"Pro–Smith Machine" advertising– Fitness Factory Outlet, 2875 South 25th Avenue, Broadview, IL 60153, Apr. 1996.

"A New Body for a New Year" advertising—National Barbell Supply, Inc., 23550 Commerce Park Road, Beachwood, OH 44122, Apr. 1996.

Quantum Enterprises advertising for Quantum's Smith Gym, Apr. 1996.

Hammer Strength—ISO–Lateral High Row, P.O. Box 19040, Cincinnati, OH 45219.

* cited by examiner

*Primary Examiner*—John Mulcahy
*Assistant Examiner*—Victor Hwang
(74) *Attorney, Agent, or Firm*—Allan L. Harms

(57) ABSTRACT

Exercise apparatus for strengthening the arm, shoulder, and back muscles. A weight bearing bar capable of holding free weights is moved through a path as the user draws a pair of elongate handles over the front of the body. As the weight bearing bar is moved, the moment arm of the weight is reduced, thereby reducing the effort required to draw the elongate levers downward as the leverage of the user's muscles declines. The elongate handles are mounted to a moveable assembly which is rotatable over a limited range and also is pivotable toward the user. The apparatus may be placed in a storage position when use is complete.

20 Claims, 4 Drawing Sheets

EXERCISE MACHINE FOR UPPER EXTREMITIES

BACKGROUND OF THE INVENTION

The present invention pertains to exercise equipment and particularly to exercise equipment for muscles of the arms, shoulders, and back of the user.

In the field of body exercise and strength training, there is a need to exercise the upper body and arms under a resistive load. Various devices have been developed to provide a resistive force to the user as the user moves his or her arms from a position with the arms extended above the head to a position with the hands positioned below the shoulders. In such equipment, the resistance is routinely provided by an arrangement of cables and pulleys which vertically lift a stack of weights as the handles of the device are brought downward. In such devices, the resistance provided by the machine remains constant, regardless whether the user has the arms and shoulders in a relatively stronger or weaker position.

In other devices, free weights mount to lever arms at a relatively high position, requiring an attendant or the user to lift free weights high in the air to mount them to the apparatus. As the user pulls down on levers, the resistance provided by the weights varies little if any as the arms are moved from an overhead position to a position in front of the chest.

In other devices, elaborate counterbalance features are required in order to make the apparatus useful to those users with lesser upper body strength due to the weight of the weight bearing structure even when not loaded.

A need exists for an easily used, safe, pull-over exercise machine which can be used by persons of various strengths and sizes and which varies the resistive load to the muscles of the arms, shoulders and back as muscle strength and leverage decline, thereby improving exercise of the muscles over a range of motion of the arms.

SUMMARY OF THE INVENTION

The present invention provides a safe and effective exercise machine which provides a varying resistance to the exercised muscles as the leverage and strength of the muscles increase or decrease over a range of motion. The invention provides an apparatus which safely exercises the muscles of the arms, shoulders and back as the arms are moved from a fully extended overhead position to a position with elbows at the side of the body. A base frame is provided with an inclined bench and seat mounted over it which allows a user to easily place himself or herself in position to exercise in a reclined position. The bench is inclined downwardly toward a first end of the base frame. A cushioned bar is mounted below the seat so that the user can place his or her legs around the cushioned bar and lock the bar behind the knees to restrain upward movement of the user's body when the loaded handles are pulled downward.

An upright support member is positioned on the base frame between the inclined bench and the second end of the base frame. Pivotally mounted to the top of the upright support is a moveable assembly which comprises a first lever and an arm mounted perpendicularly to the lever which extends away from the bench. At the free end of the arm is a transverse bar. Free weights may be selectively placed on the transverse bar as desired by the user to provide the preferred resistive load of the machine.

The arm of the moveable assembly is equipped with a downwardly depending stub arm to the side of which a roller is mounted. The roller may roll along the side of a rest support post mounted at the end of the frame to center the moveable assembly behind the user. The moveable assembly may be parked in a storage position with the roller resting in a cradle atop a rest support post mounted near the second end of the base. The first lever of the moveable assembly is provided with a cross member at its free end. The cross member is centered on the first lever and each end of the cross member has an elongate handle angularly extending from it toward the upper end of the bench.

After loading the transverse bar with free weights as desired, the user may position himself or herself on the machine, reach upwardly and grasp the elongate handles and pull down on the handles slightly to lift the roller from the cradle. The user then rotates the moveable assembly slightly so the roller is out of alignment with the cradle and then may fully extend the arms overhead to commence an exercise session. The exercise activity comprises alternately retracting and extending the arms to exercise the upper body muscles as the weights on the transverse bar are moved over a path which reduces the moment arm of the weights as the handles are pulled downward. When the exercise session is finished, the user retracts the handles part way and rotates the moveable assembly to alignment over the rest support and then lowers the roller into the cradle to rest the apparatus in its storage position.

It is an object of the invention to provide an overhead pull apparatus which eases in resistance as the arms are moved to positions of reduced strength and leverage.

It is also an object of the invention to provide an exercise apparatus which prevents the user from being displaced as the user pulls on the overhead pull levers.

It is a further object of the invention to provide an overhead pull apparatus which allows the user to remove the apparatus from a storage position while in position on the device ready to exercise.

It is a further object of the invention to provide an overhead pull exercise apparatus which may be used by persons of a wide variety of strengths and sizes.

These and other objects will be understood from review of the detailed description below.

DESCRIPTION OF THE DRAWING FIGURES

DETAILED DESCRIPTION OF THE INVENTION

Figure 1:
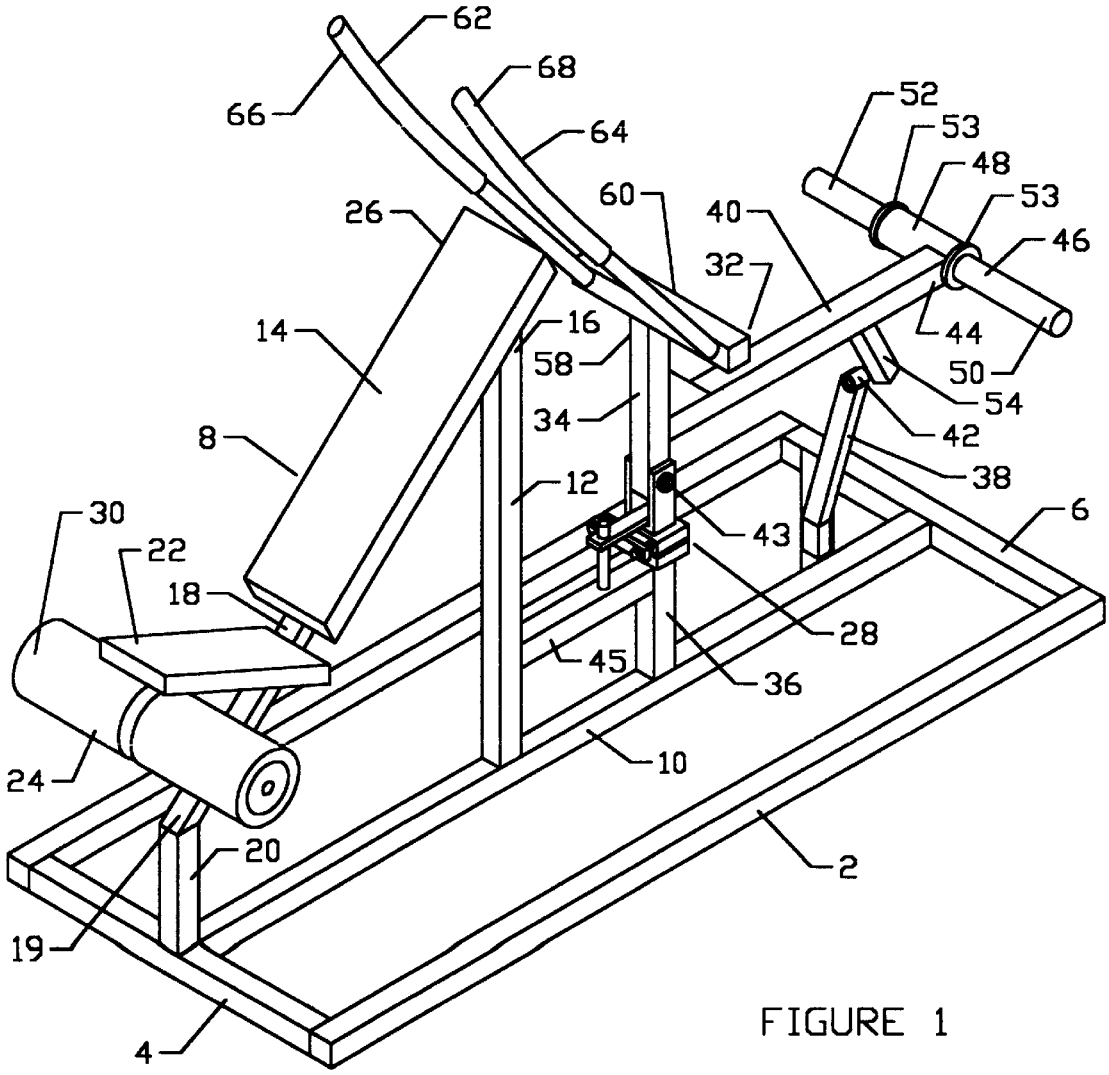
FIG. 1 is a front left perspective of the preferred embodiment of the invention in a storage position with the moveable assembly resting on the rest support post.
Figure 2:
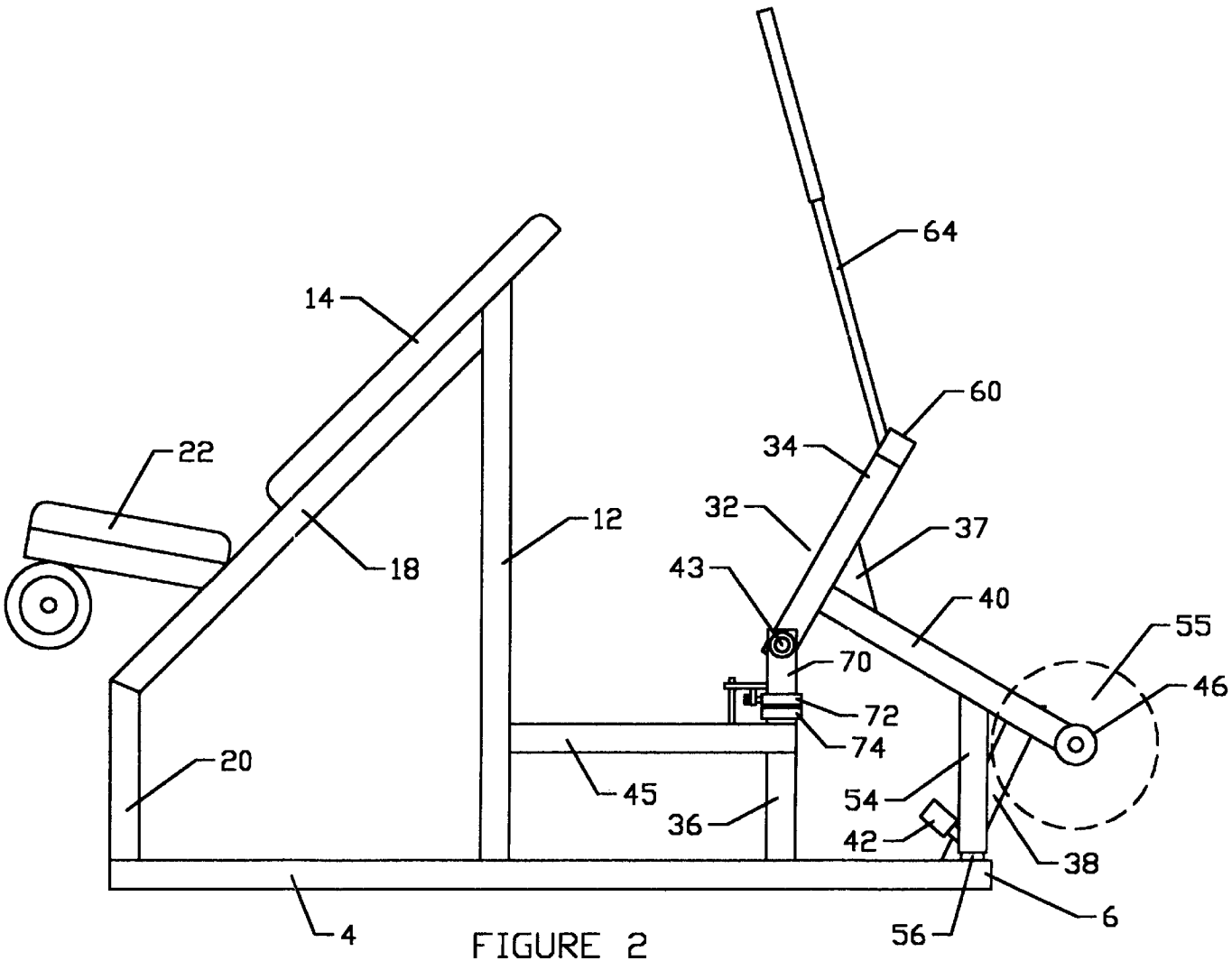
FIG. 2 is a front elevation of the preferred embodiment of the invention with free weights shown by dashed lines, the invention being shown in the position with the moveable assembly disengaged from the rest support post and rotated maximally away from the bench.

In FIG. 1, the preferred embodiment of the invention is isometrically illustrated, while a front elevation of the device is shown in FIG. 2 with weight plates 55 thereon shown in phantom. A base frame 2 includes a first end 4 and a second end 6, with a user support assembly 8 mounted above the base frame 2 and substantially axially centered thereon above central rail 10. User support assembly 8 comprises a first upright member 12 mounted to central rail 10 which, at its higher end 16, supports inclined rail 18. Inclined rail 18 is supported at its lower end 19 by its mounting atop support post 20 which is mounted upright upon first end 4 of base frame 2. Inclined bench 14 is mounted upon inclined rail 18 and is disposed above seat 22 which depends from inclined rail 18 in a generally horizontal direction. Seat 22 and inclined bench 14 provide a rest on which the exercising user may recline.

A knee lock bar 24 is transversely mounted below seat 22 so that a user may place the user's legs around knee lock bar 24 such that it is behind the user's knees while the user sits on the seat 22 so that the user's pulling on handle members 62 and 64 will not pull the user upward along inclined bench 14. Knee lock bar 24 is provided with foam surrounds 30 to cushion it.

Disposed between user support assembly 8 and second end 6 of base frame 2 is moveable assembly 32 which comprises a first lever 34 which is pivotable at its lower end upon pivot support member 36. An elongate arm 40 cantilevers perpendicularly from first lever 34 toward the second end 6 of base frame 2. A gusset 37 strengthens the mounting of elongate arm 40 to first lever 34. A stabilizer beam 45 is disposed between first upright member 12 and pivot support member 36.

At the free end 44 of elongate arm 40 is transversely mounted a weight carrying bar 46 which is provided with a central segment 48 and opposing rod ends 50, 52. Weight carrying bar 46 is centered on free end 44 of arm 40, but central segment 48 is not. Hence, one rod end 50 of weight carrying bar 46 is longer than the other rod end 52. Weight carrying bar 46 is provided to receive commonly used free weights 55 of circular plate shape which may be selectively added or removed from weight carrying bar 46 according to the resistance desired by the user. Weight plate 55 is preferably an "Olympic" weight with a two-inch diameter hole. Hence rod ends 50, 52 are preferably slightly less then two inches in diameter. Resilient washers 53 are mounted adjacent the opposing ends of central segment 48.

The height of pivot support member 36 is selected such that the weight carrying bar 46 is never movable past a vertical over pivot pin 43.

At the upper end 58 of first lever 34 is mounted a cross member 60 to which are mounted handle members 62 and 64 at the opposing ends of cross member 60. Left and right handle members 62 and 64 extend upwardly and toward upper end 26 of inclined bench 14 at an angle of approximately forty-five degrees from the axis of first lever 34.

Mounted to and depending below arm 40 is a stub arm 54 which is fixed to arm 40 at an acute angle from free end 44 thereof, and thereby extends toward second end 6 of base frame 2 such that, as moveable assembly 32 pivots about pivot pin 43 away from inclined bench 14, the free end of stub arm 54 will reach abutment on top of second end 6 of base frame 2 and prevent further rotation of moveable assembly 32. The length of stub arm 54 may be selected such that handle members 62 and 64 will be moveable just out of the reach of the outstretched hands of most users. Therefore, the apparatus is typically parked in an intermediate position for storage at which the handles may be easily grasped by most users.

Stub arm 54 is provided with a bearing member, specifically a roller 42 mounted to one of its sides. The roller 42 is disposed so its axis is generally parallel to the axis of arm 40 and further so that roller 42 may rest in a storage position on the top of rest support post 38. Rest support post 38 extends above base frame 2 and is disposed angularly such that the locus of travel of roller 42 will generally coincide with the incline of rest support post 38.

Figure 5:
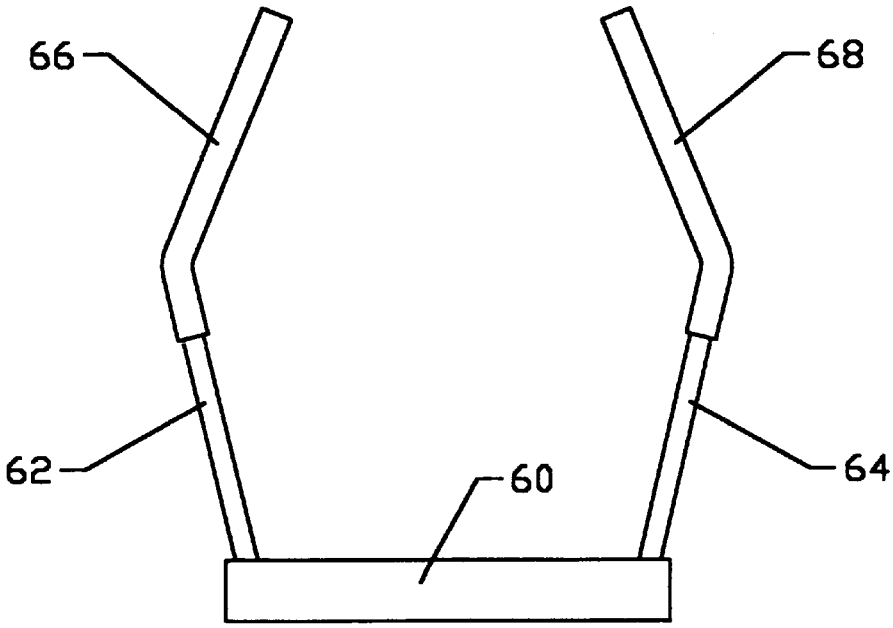
FIG. 5 is a top plan view of the handles and cross member of the moveable assembly of the preferred embodiment.

In FIG. 5 it is seen that each handle member 62 and 64 is provided with an inwardly directed segment 66, 68, each distal from the mounting of each handle member 62, 64 to cross member 60. Curved handle members 62, 64 are slightly concave relative to the space between them and are sleeved with cushioned material or a cushioning coating. The angle of inwardly directed segments 66 and 68 is selected to provide a comfortable hold for the user who will reach over his or her head to grasp handle members 62, 64 along inwardly directed segments 66, 68. This arrangement facilitates the user in drawing handles 62, 64 from a position above the user's head to a position even with the user's chest without allowing the elbows of the user to spread from his or her body, thereby preventing unnecessary stress on the ball and sockets of the shoulders of the user.

Figure 3:
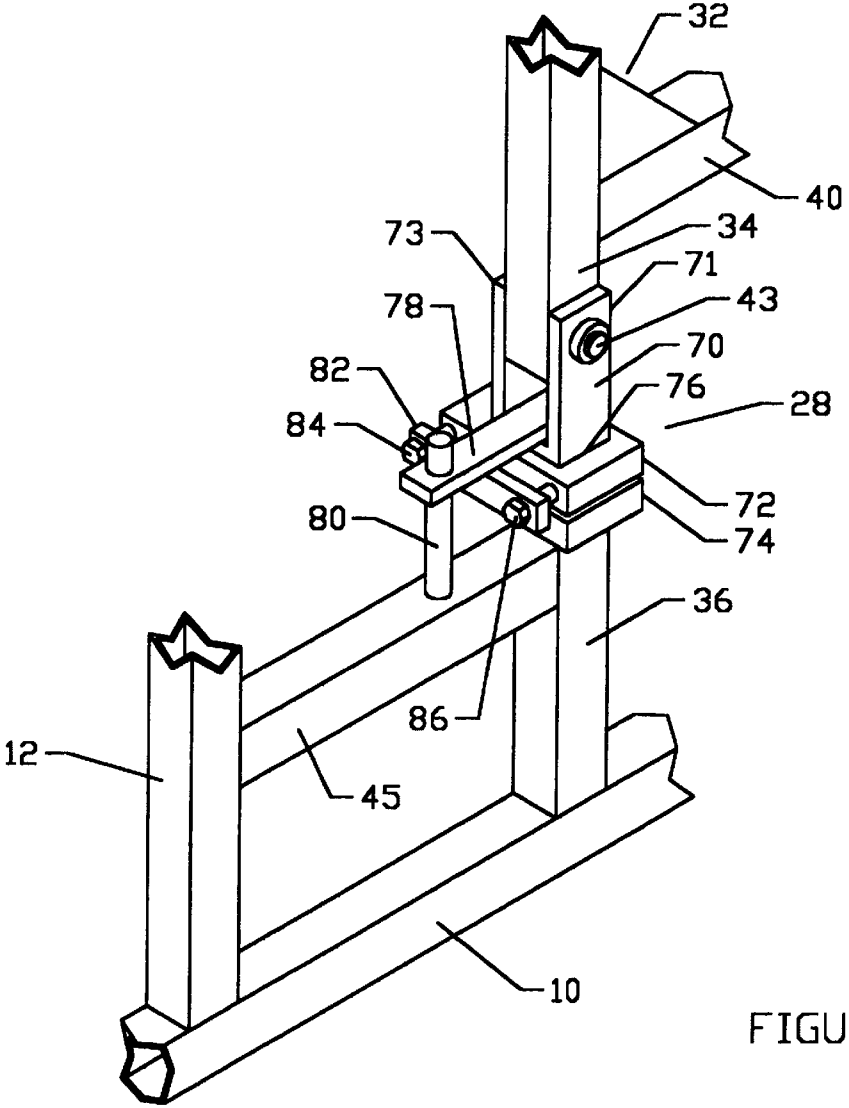
FIG. 3 is an expanded front left perspective view of the compound pivot structure of the preferred embodiment of the invention.

FIG. 3 discloses the detail of the compound pivot member 28 interconnecting moveable assembly 32 and pivot support member 36. A U-shaped yoke 70 is fixed by pivot pin 43 to first lever 34 such that first lever 34 may pivot about pivot pin 43. The first lever 34 is moveable within a vertical plane defined by the axes of pivot support member 36 and stabilizing beam 45.

U-shaped yoke 70 is fixed at its lower end 76 to upper bearing plate 72 which is separated by a washer or other similar bearing element from lower bearing plate 74. Thus U-shaped yoke 70 and hence moveable assembly 32 may rotate upon pivot support member 36 about its substantially vertical axis. The axial rotation of moveable assembly 32 is limited by the presence of tongue 78 which protrudes into the space between opposing legs 71 and 73 of U-shaped yoke 70. Tongue 78 is fixedly mounted to stabilizing arm 45 by vertical post 80. Transversely mounted below tongue 78 is plate 82 which provides adjustment screws 84, 86 at the opposing ends of plate 82. Adjusting screws 84 and 86 are selectively adjusted to provide limits for the rotation of upper bearing plate 72, thereby limiting the range of rotation of moveable assembly 32 to about ten degrees of rotation.

Figure 4:
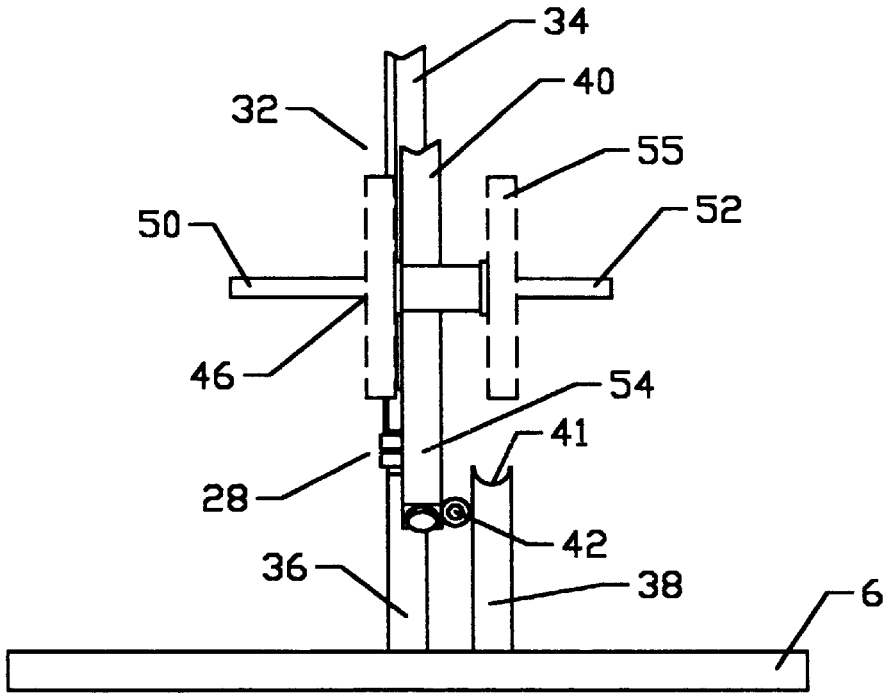
FIG. 4 is an end plan view of the invention with parts omitted, showing operation of the roller along the rest support post.

FIG. 4 illustrates the structure and function of roller 42 when moveable assembly 32 has been lifted from its storage position with roller 42 resting in concave cradle 41 which is mounted atop rest support post 38. If the user does not exert equal force on each of handles 62, 64 as moveable assembly 32 is rotated about pivot pin 43 toward inclined bench 14, moveable assembly 32 may rotate about the vertical axis until roller 42 abuts the side of rest support post 38. As handle members 62, 64 are drawn downward by the user's outstretched arms, roller 42 may roll along rest support post 38 thereby reducing frictional resistance and causing moveable assembly 32 to remain essentially centered behind the user reclining on inclined bench 14. The limits of rotation of moveable assembly 32 due to the effect of screws 84, 86 engaging upper bearing plate 72 prevents moveable assembly 32 from becoming seriously misaligned as it is pivoted about pivot pin 43.

FIG. 2 illustrates the position of moveable assembly 32 when roller 42 is separated from its storage position atop rest support post 38 and weight carrying bar 46 is lowered to its fully extended position with stub arm 54 abutting base frame 2 and resting on bumper 56.

OPERATION OF THE INVENTION

As can be understood from the drawings, with the apparatus in its storage position with roller 42 resting in cradle 41, a user places himself or herself on inclined bench 14 and seat 22 in a reclined position. The user may then reach up and backward and grasp elongate handle members 62 and 64. At that point, the user is ready to release the moveable assembly and commence the exercise maneuvers. By grasping left and right handle members 62 and 64 at the inwardly directed segments 66 and 68 respectively, the user may draw the handle members 62 and 64 toward the user far enough to disengage roller 42 from cradle 41. The user then rotates the moveable assembly 32 into a centered position and exercises upper extremity muscles by alternately extending the arms overhead and drawing the elbows to the user's sides. As the first lever 34 pivots about pivot pin 43, the weight carrying bar 46 and free weight plates 55 positioned thereon are moved through an arc which varies the moment arm between weight carrying bar 46 and pivot pin 43 thereby decreasing the vector force of the free weights as the elbows of the user are drawn toward the sides of the user in which position less muscle strength is present. As the elbows of user reach the sides of the user, the free weight plate 55 continues to be outboard of the pivot pin 43 though the force required to finish the movement declines as the axis of the free weight plates 55 approaches alignment over the pivot pin 43. As a result, a decreasing load is presented to the user as the natural strength of the user declines in the range of motion of the exercise. When the exercise session is complete, the apparatus may be parked in its storage position with the roller 42 lowered into the concave cradle 41.

Having described the invention, I claim:

1. Exercise apparatus comprising a base with an inclined bench supported thereupon, the inclined bench having a lower end and a higher end, a moveable assembly supported upon said base and spaced apart from the higher end of said inclined bench, the moveable assembly comprising a first lever, an arm extending from the first lever, and a weight-carrying member mounted to said arm, said moveable assembly pivotably mounted to said base to pivot about a horizontal axis, said moveable assembly rotatable mounted to said base to rotate about a vertical axis, a pair of spaced apart handle members extending from said first lever toward said higher end of said bench, said horizontal pivot axis disposed laterally between said weight-carrying member and said handle members, each of said spaced apart handle members disposed toward an opposing side of said inclined bench, said weight-carrying member operable to receive weights thereon.

2. The exercise apparatus of claim 1 wherein said base has a first end and a second end, said inclined bench is disposed on said base with its lower end adjacent said first end of said base, said movable assembly is disposed between said inclined bench and said second end of said base, said movable assembly is disposed in substantial alignment with said inclined bench so that a user supported on said inclined bench may engage said moveable assembly, said arm extends generally perpendicularly from said first lever.

3. The exercise apparatus of claim 1 wherein said base has a first end and a second end, a rest support post upstands from said base adjacent said second end thereof, said arm having a stub arm depending therefrom, said stub arm having a bearing element laterally mounted thereto, said bearing element abutting said rest support post at the top thereof when said exercise apparatus is in a storage position.

4. The exercise apparatus of claim 3 wherein said bearing element is a roller on an axle, said axle substantially parallel to said arm.

5. The exercise apparatus of claim 4 wherein said rest support post is provided with a cradle at the top thereof, said roller rests in said cradle when said apparatus is in a storage position.

6. The exercise apparatus of claim 1 wherein said movable assembly is supported by a pivot support member which upstands from said base and is located therealong.

7. The exercise apparatus of claim 6 wherein said base has a first end and a second end, a first supporting member upstands from said base, said first supporting member disposed upon said first end of said base, a second supporting member upstands from said base, said second supporting member is disposed between said first end and said pivot support member, said inclined bench is supported upon said first supporting member and said second supporting member.

8. The exercise apparatus of claim 1 wherein said base has a first end and a second end, a seat is supported over said base, the seat mounted adjacent said lower end of said inclined bench, said seat supported generally above the first end of said base.

9. The exercise apparatus of claim 8 wherein a transverse bar is disposed below said seat, said transverse bar substantially perpendicular to the axis of said inclined bench.

10. Exercise apparatus of claim 1 wherein said base has a first end and a second end, said moveable assembly rotatably mounted to said base to rotate about a vertical axis, a first upstanding support post disposed upon said first end of said base, a second upstanding support post disposed along said base, an inclined bar supported upon said first upstanding support post and upon said second upstanding support post, said inclined bench supported upon said inclined bar, said inclined bar having a seat supporting bar extending therefrom, said seat supporting bar overlying said first end of said base, a seat mounted upon said seat supporting bar, the seat mounted adjacent said lower end of said inclined bench, a transverse cushioned bar disposed below said seat, the transverse cushioned bar extending from opposing sides of said seat, a third upstanding support post mounted to said base between said second upstanding support post and said second end of said base, a fourth upstanding support post mounted adjacent said second end of said base, the fourth upstanding support post having a concave upper end, said moveable assembly supported over said base between said upper end of said bench and said second end of said base, said arm extending perpendicularly from said first lever and having a free end, said weight-carrying member mounted to said free end of said arm, said weight-carrying member disposed substantially horizontally, said arm having a stub arm depending therefrom, said stub aim having a bearing member mounted therealong, said bearing member comprising a roller bearing on an axle, said axle mounted to said stub arm, said axle of said bearing member disposed substantially parallel to the axis of said arm, said free end of said arm disposed over said second end of said base when said moveable assembly is at rest, said moveable assembly supported upon said third upstanding support post, said first lever of said moveable assembly axially rotatable upon said third upstanding support post, the rotation of said first lever bar limited by stop means, said stop means selectively adjustable, each of said spaced apart handle members curved toward the other, each of said spaced apart handle members having a cushion along a section thereof, said weight-carrying member having smaller cross section extensions sized to receive individual weight plates thereon, whereby a user reclining upon said bench and resting on said seat may grasp said handle members and pivot said moveable assembly.

11. The exercise apparatus of claim 1 wherein said moveable assembly has a rest position and an operating position, a rest support member upstands from said base spaced apart from said horizontal axis of pivot of said moveable assembly, said rest support member having an upper end, said arm having a stub arm depending therebelow, the stub arm supported upon said upper end of said rest support member when said moveable assembly is in the rest position, said movable assembly supported above said base by a pivot support member located between said rest support member and said inclined bench, whereby a user reclining on said inclined bench while said moveable assembly is in said rest position may grasp said handles without fully extending the user's arms.

12. An exercise system comprising an inclined bench having a higher end and a lower end, a loadable member disposed apart from said higher end of said inclined bench and aligned generally therewith for engagement by a user supported on said inclined bench, the loadable member rotatable mounted for rotation about a substantially vertical axis, said loadable member comprising a first lever, an arm extending from said first lever, means for selectively weighing said arm, and handle members extending from said first lever in a direction opposite to that of said arm, said handle members extending toward said higher end of said bench, said loadable member pivotably mounted to pivot about a substantially horizontal axis, said horizontal axis of pivot disposed horizontally between said arm of said loadable member and said handle members thereof.

13. The exercise system of claim 12 wherein said arm has a stub arm depending therefrom along the length thereof, said stub arm having a first side, said first side having a bearing member mounted thereto, an upstanding member spaced a fixed distance from said higher end of said bench, said upstanding member having a bearing surface therealong, said bearing member touchingly engageable with said bearing surface when said loadable member is pivoted through a segment of its range of pivot.

14. The exercise system of claim 13 wherein said bearing member is a roller rotatable on a shaft mounted to said first side of said stub arm.

15. The exercise system of claim 14 wherein said rotation of said loadable member is limited to approximately ten degrees, said bench has a seat member disposed near the lower end thereof, said seat disposed generally horizontally, a transverse bar is mounted below said seat member, said transverse bar is generally perpendicular to the axis of said inclined bench, said means for selectively weighting said arm comprises a transverse rod mounted to said arm.

16. The exercise system of claim 12 wherein said rotation of said loadable member is limited.

17. The exercise system of claim 16 wherein said rotation of said loadable member is limited to approximately ten degrees.

18. The exercise apparatus of claim 12 wherein said bench has a seat member disposed near the lower end thereof, said seat disposed generally horizontally.

19. The exercise apparatus of claim 18 wherein a transverse bar is mounted below said seat member, said transverse bar is generally perpendicular to the axis of said inclined bench.

20. The exercise system of claim 12 wherein said means for selectively weighting said arm comprises a transverse rod mounted to said arm.

* * * * *